US005806344A

United States Patent [19]

Bonchek

[11] Patent Number: 5,806,344

[45] Date of Patent: Sep. 15, 1998

[54] DUAL LOCKING RINGS

[76] Inventor: Herschel Bonchek, 41 Rechov Hakablan, Apt. 6, Har Nof 93874, Israel

[21] Appl. No.: 658,756

[22] Filed: Jun. 5, 1996

[30] Foreign Application Priority Data

Jun. 7, 1995 [IL] Israel ..... 114057

[51] Int. Cl.[6] ..... A44C 9/00

[52] U.S. Cl. ..... 63/15.1; 63/15.2

[58] Field of Search ..... 63/15, 15.1, 15.2, 63/15.3, 15.4; D11/27, 28, 34, 35

[56] References Cited

U.S. PATENT DOCUMENTS

| | | | |
|---|---|---|---|
| 1,656,807 | 1/1928 | Zindel | D11/34 X |
| 2,048,878 | 7/1936 | Moldenhauer | 63/15 |
| 4,118,948 | 10/1978 | Gralink | 63/15 |
| 5,253,490 | 10/1993 | Doganay | 63/15 X |

FOREIGN PATENT DOCUMENTS

| | | | |
|---|---|---|---|
| 2440704 | 7/1980 | France | 63/15.3 |

*Primary Examiner*—Kien T. Nguyen
*Attorney, Agent, or Firm*—Renner, Otto, Boisselle & Sklar, P.L.L.

[57] ABSTRACT

A dual locking ring including a first ring and second ring, such as an engagement ring and a wedding ring. The first ring includes a band and at least one protrusion extending radially therefrom. The second ring includes at least one band having a receptacle for the protrusion. The protrusion and the receptacle lockingly attach the first and second rings together. The bands of the first and second rings have substantially the same inner diameter. In this manner, an engagement ring and a wedding ring may be worn on the same finger, with each being visible and without the rings twisting, turning, or sliding away from each other.

28 Claims, 4 Drawing Sheets

DUAL LOCKING RINGS

FIELD OF THE INVENTION

The present invention relates to a dual ring which is generally worn on one finger. More specifically, the invention relates to a pair of rings such as a wedding band and an engagement ring which are generally worn together on one finger.

BACKGROUND OF THE INVENTION

The engagement ring is generally a plain band with a single ornamental stone, usually a diamond, or at most a cluster of ornamental stones concentrated in a limited portion of the band. Thus, the engagement ring is always worn with the stone portion facing outward.

Generally, the wedding ring comprises a single major band which is worn on the same finger. The band may be gold with an ornamented/engraved surface, or it may include ornamental stones such as diamonds, rubies or emeralds in portions of the periphery of the ring. In some cases, the ring may include front and back arc segments which are different from each other, e.g., one arc segment might contain rubies (red) and an opposite arc segment could be set with emeralds (green). The ring then gives a different appearance depending on whether the ruby arc segment is on the outside of the hand, or the emerald arc segment faces outward.

Thus, it is possible to achieve two different appearances of the dual ring, by wearing either one or the other set of ornamental stones facing outward. However, this entails the necessity of wearing one set of stones facing inward, where the stones are exposed to wear, abrasion, scratching and the possibility that the stones worn facing the inside of the hand will fall out if the gold holding them catches on clothing or hits an object during the course of normal activities carried on by the hand. In addition, it is desirable to have some means of preventing the ring with the stones from inadvertently twisting around the finger so as to expose the set of stones which is intended to be hidden from view.

It is known to provide a dual ring having an integral protector to avoid wear. U.S. Pat. No. 5,027,617 to the inventor of the present invention, describes a dual ring with a protector arranged to be worn together on one finger. One of the pair of rings has an integral protective channel which is adapted to receive the second ring of the pair. The second ring of the pair has ornamentation around its circumference which requires protection from scratching, abrasion, and the possibility that the stones worn facing the inside of the hand will fall out if the gold holding them catches on clothing or hits an object. The protective channel of the first ring is adapted to receive the second ring and protects the complete inner portion, facing the inside of the hand.

Since engagement and wedding rings are generally worn on the same finger, there is a tendency for the rings to twist and turn relative to each other. Though the dual ring protects the stones worn facing the inside of the hand, it does not prevent the rings from moving. Overlapping rings which interlink with each other are known. However, these interlinked rings merely fit together but are not securely attached so that one of the rings can still slide away from the second ring.

SUMMARY OF THE PRESENT INVENTION

It is an object of the present invention to provide a dual ring which lockingly connects one ring to a second ring.

There is therefore provided, in accordance with a preferred embodiment of the present invention, a dual locking ring, which includes a first ring including a first ring band and at least one protrusion and a second ring including at least one second ring band having a receptacle for the protrusion. The protrusion and the receptacle lockingly attach the first and second rings together.

Additionally, in accordance with a preferred embodiment of the present invention, the at least one protrusion is at least one pair of protrusions defining a gap therebetween and the receptacle is a channel, integrally formed with the second ring band, of length generally equal to the dimension of the gap, to receive the pair of protrusions therearound. The first ring band has at least one set of jewels set between the protrusions. The set of jewels can have one or more jewels therein.

Additionally, in accordance with a preferred embodiment of the present invention, the first ring band has two sets of protrusions and two sets of jewels. Each set of jewels is set between each set of protrusions and the channel is the width of the set of jewels.

Furthermore, in accordance with another preferred embodiment of the present invention, the ring has two pairs of protrusions, each of the pairs of protrusions defining a gap therebetween. The first ring band has at least one set of jewels set between the protrusions, the second ring includes two second ring bands and the receptacle is a bridge, integrally formed between the two second ring bands, of length generally equal to the dimension of the gap, to receive the pair of protrusions therearound.

Additionally, in accordance with a preferred embodiment of the present invention, the first ring is generally round and the outer circumferences of the second ring bands are non-round at least in a location corresponding to where one of the sets of jewels is located, in order to protect the set of jewels. For example, the sets of jewels can be located on the top and bottom of the first ring and the non-round section can be located at the bottom of said second ring band.

Furthermore, in accordance with another preferred embodiment of the present invention, the ring has at least one pair of protrusions defining a gap therebetween, wherein the second ring includes two second ring bands. The receptacle is a bridge, integrally formed between the two second ring bands, of length generally equal to the dimension of the gap, to receive the pair of protrusions therearound.

Additionally, in accordance with a preferred embodiment of the present invention, the ring includes a second bridge, approximately 180° from the first bridge, wherein a jewel is mounted over one of the bridges. The bridge is the width of a jewel. The first ring band has at least one set of jewels set outside the protrusions. The first ring is generally round and the outer circumference of the second ring bands is non-round, as described hereinabove, in order to protect the at least one set of jewels.

Furthermore, in accordance with another preferred embodiment of the present invention, the protrusion is connected to a flange connected to the first ring and the receptacle is a hole within the second ring band, the hole having an inner diameter generally equal to the outer diameter of the protrusion. The first ring includes a single jewel and the second ring includes at least one jewel set on the opposite side of the second ring band to the hole.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

Figure 1A:
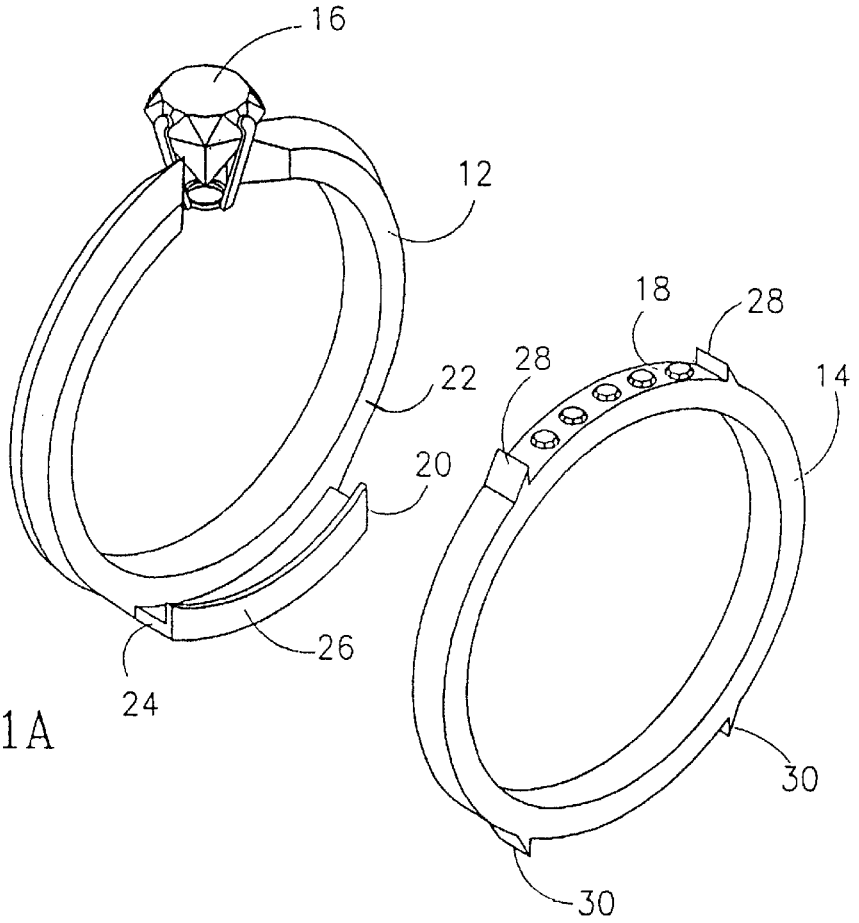
FIG. 1A is an exploded drawing of the dual ring, constructed and operative in accordance with a first embodiment of the present invention.
Figure 1B:
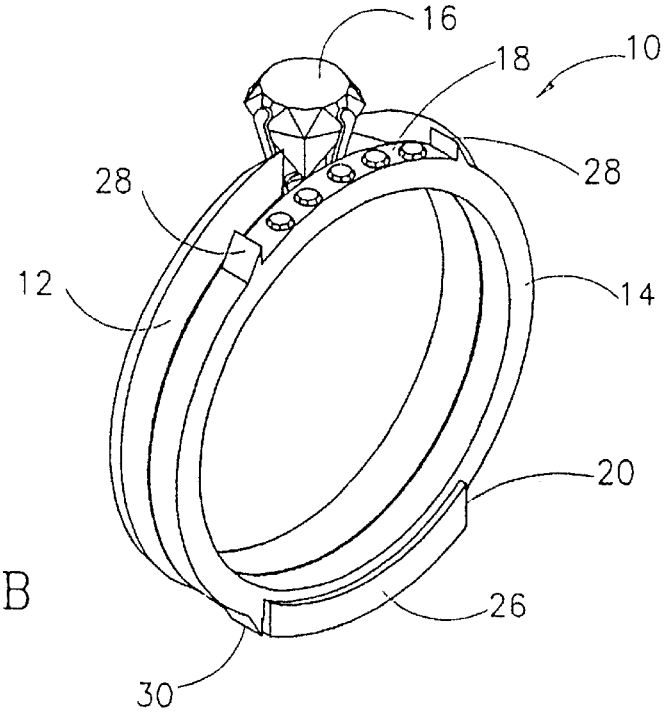
FIG. 1B is a perspective view of the dual locking ring of FIG. 1A.

Reference is now made to FIGS. 1A and 1B which illustrate a dual locking ring 10, constructed and operative in accordance with a first embodiment of the present invention. The exploded drawing of FIG. 1A shows the detail of the dual locking ring and the FIG. 1B illustrates both rings fitted together.

Dual locking ring 10 comprises first and second rings 12 and 14, respectively. For the purposes of example only, first ring 12 comprises a ring having a single stone 16 and second ring 14 comprises a ring having a plurality of ornamental stones 18. Ring 12 further comprises a protective integrally formed channel 20 located opposite to single stone 16. Ornamental ring 14 fits into protective channel 20 of ring 12. Integral channel 20 is defined by one face 22 of ring 12, an integral projection 24 from ring 12 and an integral flat segment 26 parallel to face 22.

Ring 14 further comprises a pair of integral protrusions 28 located on either side of ornamental stones 18. A second pair of integral protrusions 30 are located on the opposite side of integral protrusions 28. The shorter distance between each of the pair of integral protrusions 28 matches the length of integral channel 20 so that integral protrusions 28 clip onto integral channel 20, thereby securing ornamental ring 14 in place. Ornamental ring 14 may also comprise a second set of ornamental stones (not shown) located between integral protrusions 30. Ornamental ring 14 may thus be inserted into integral channel 20 so that either set of ornamental stones is exposed to view.

Figure 2A:
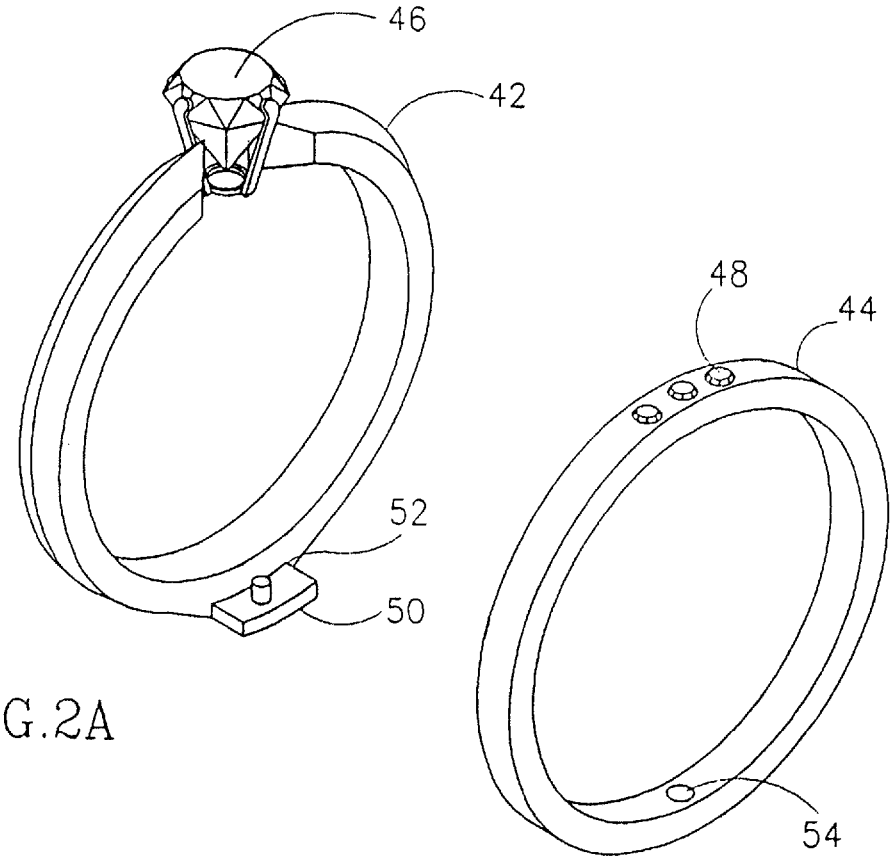
FIG. 2A is an exploded drawing of a second embodiment of the present invention.
Figure 2B:
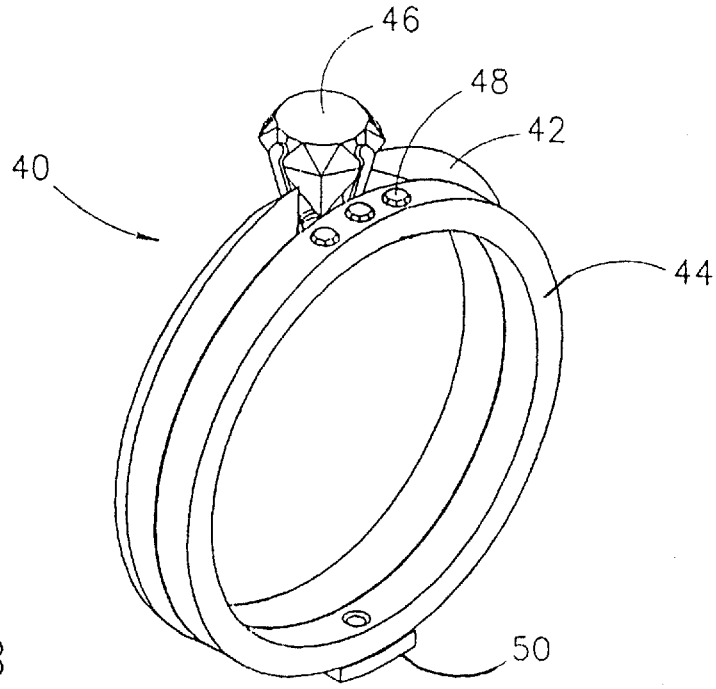
FIG. 2B is a perspective view of the dual locking ring of FIG. 2A.

A second embodiment of the dual locking ring 40 is shown in FIGS. 2A and 2B. FIG. 2A shows an exploded detail of the dual locking ring and FIG. 2B illustrates both rings fitted together. In this embodiment, the rings are secured together using a mortise and tenon like arrangement, as described hereinbelow.

Dual locking ring 40 comprises first and second rings 42 and 44, respectively. First ring 12 comprises a ring having a single stone 46 and second ring 44 comprises a ring having a plurality of ornamental stones 48. Ring 42 further comprises a dependent flange 50 located opposite to single stone 46. Dependent flange 50 comprises a projection 52. Projection 52 may be any shape, for example cylindrical as shown. A hole 54 is formed within ornamental ring 44 corresponding in shape and size to projection 52, so that ornamental ring 44 fits securely onto the projection 52 of ring 42. In this locking arrangement, projection 52 and hole 54 are similar to a tenon and mortise arrangement, respectively.

Figure 3A:
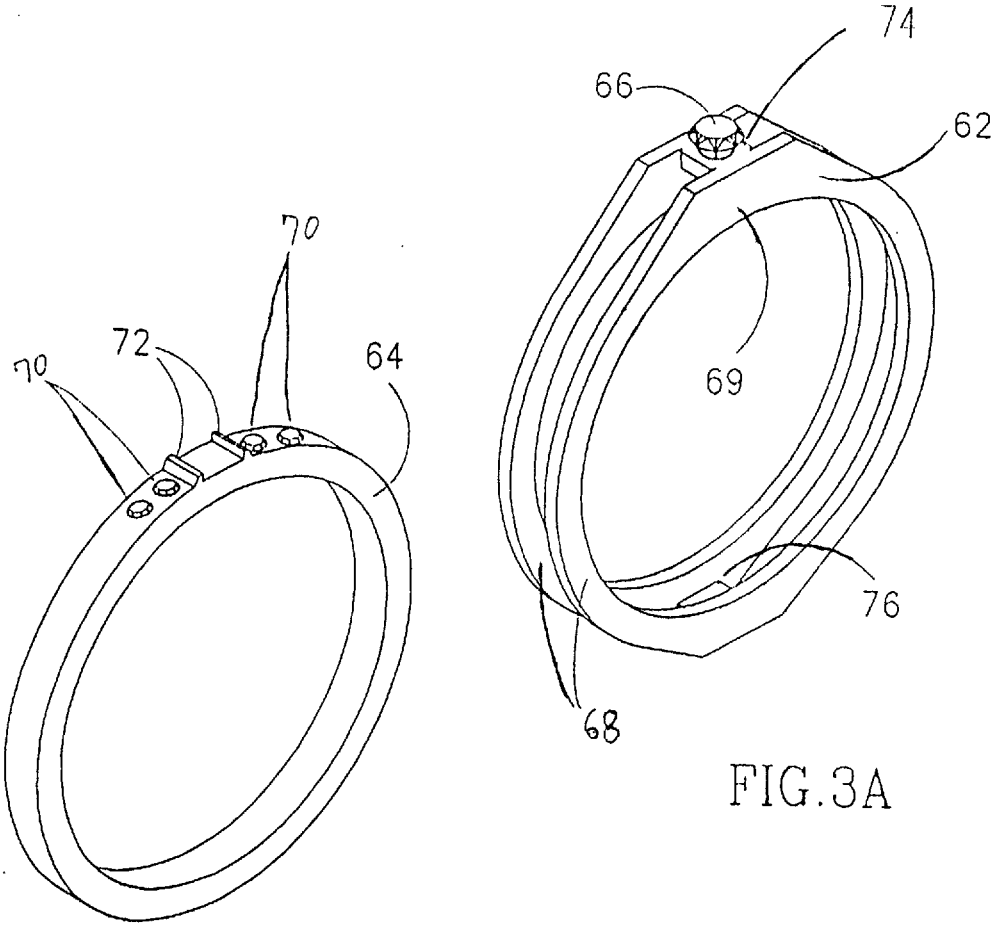
FIG. 3A is an exploded drawing of a third embodiment of the present invention.
Figure 3B:
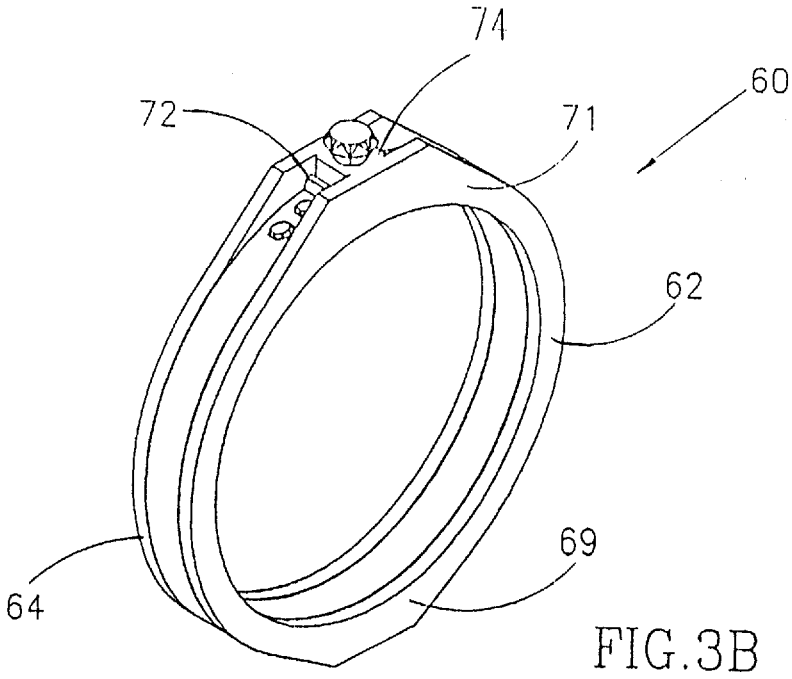
FIG. 3B is a perspective view of the dual locking ring of FIG. 3A.

A third embodiment of the dual locking ring 60 is shown in FIGS. 3A and 3B. FIG. 3A shows an exploded detail of the dual locking ring and FIG. 3B shows both rings fitted together. Dual locking ring 60 comprises first and second rings 62 and 64, respectively. First ring 62 comprises a ring having a single stone 66 bridging a pair of double rings 68. Second ring 64 comprises a ring having a plurality of ornamental stones 70 separated by a pair of protrusions 72

Double rings 68 are connected by first bridge 74 clasping stone 66 and a second bridge 76 located opposite to stone 66. The faces 69 of double rings 68, adjacent to second bridge 76, are wider and deeper, as shown, in order to protect the ornamental stones 70 of ring 64. Similarly, the faces 71 of double rings 68, adjacent to first bridge 74, may also be widened. The width of first bridge 74 incorporating stone 66 matches the shorter distance between the pair of protrusions 72. The width of second bridge 76 matches the width of first bridge 74. Ornamental ring 64 is inserted between the pair of double rings 68 and is retained in place by protrusions 72 which clip onto bridge 74 of ring 62. Second bridge 76 provides additional support to ring 64.

Optionally, ornamental ring 64 can also comprise a second set of ornamental stones (not shown) located opposite to the first set of ornamental stones 70. Ornamental ring 64 can be turned round so that the second set of ornamental stones is visible adjacent to single stone 66. In this case, ornamental ring 64 is retained in place by protrusions 72 which clip onto second bridge 76 at the bottom of ring 62.

Figure 4A:
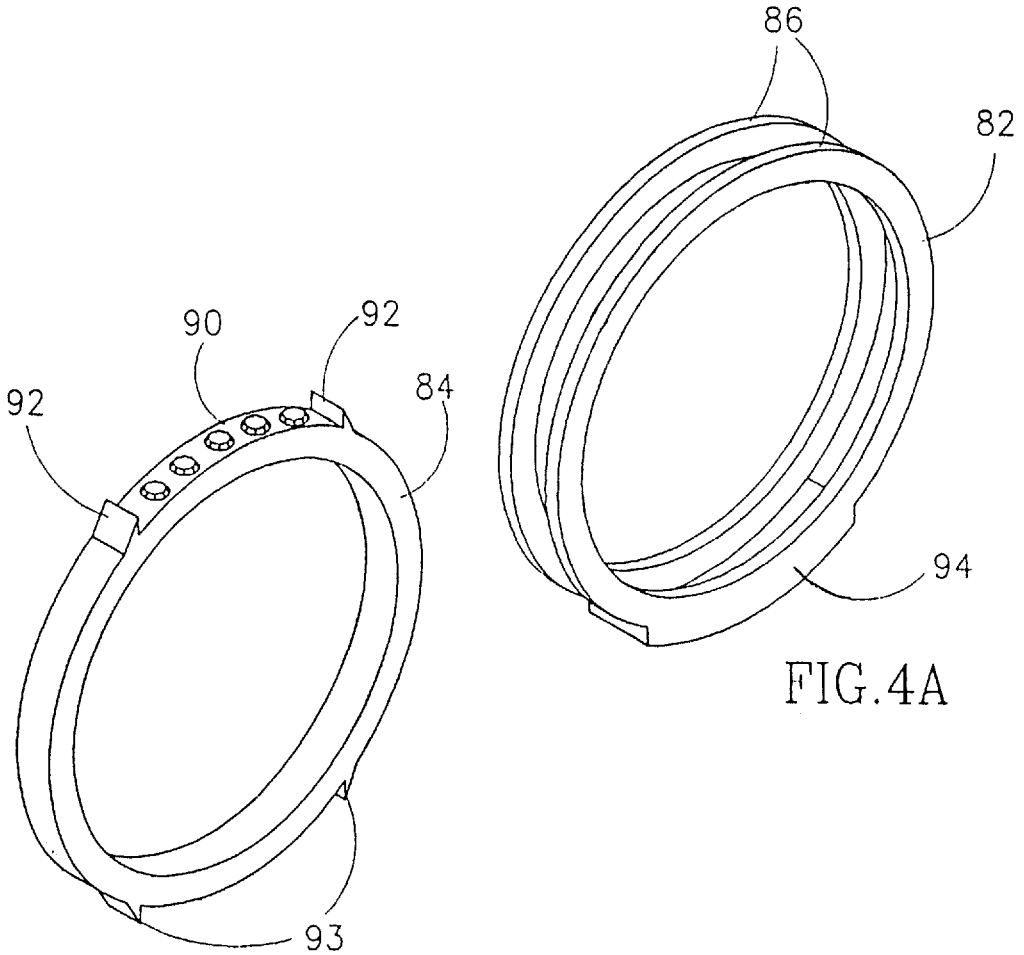
FIG. 4A is an exploded drawing of a fourth embodiment of the present invention.
Figure 4B:
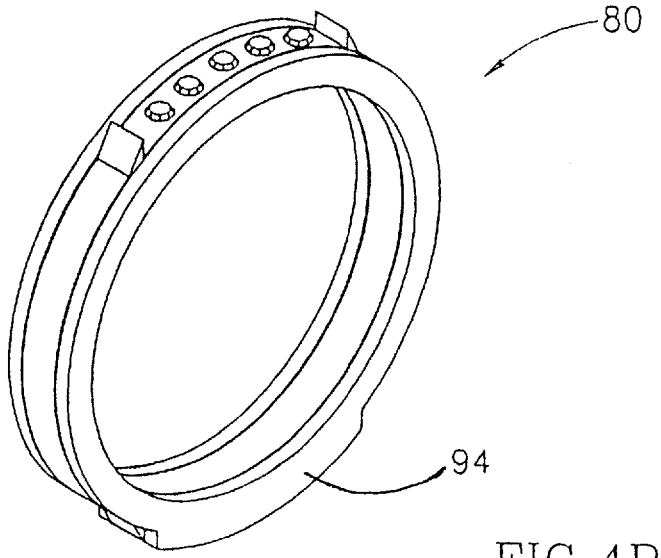
FIG. 4B is a perspective view of the dual locking ring of FIG. 4A.

A further embodiment of the dual locking ring 80 is shown in FIGS. 4A and 4B. FIG. 4A shows an exploded detail of the dual locking ring and FIG. 4B shows both rings fitted together. Dual locking ring 80 comprises first and second rings 82 and 84, respectively. First ring 82 comprises a pair of double rings 86 which are connected by a bridge 88. Second ring 84 comprises a ring having a plurality of ornamental stones 90 separated by a pair of protrusions 92. Ornamental ring 64 also comprises a second pair of protrusions 93 located opposite to the first pair of protrusions 92. Optionally, ornamental ring 64 can also comprise a second set of ornamental stones (not shown) between the second pair of protrusions 93.

The faces 94 of double rings 86, adjacent to bridge 88, are wider and deeper in order to protect the ornamental stones 90. The width of bridge 88 matches the distance between the pair of protrusions 92. Ornamental ring 84 is inserted between the pair of double rings 86 and is retained in place by the second pair of protrusions 93 which clip onto bridge 88 of ring 82. Ornamental ring 84 can be turned round so that the second set of ornamental stones is visible.

It will be appreciated by persons skilled in the art that the present invention is not limited to what has been particularly shown and described hereinabove. Rather the scope of the present invention is defined by the claims which follow:

It will be appreciated by persons skilled in the art that the present invention is not limited to what has been particularly shown and described hereinabove. Rather the scope of the present invention is defined only by the claims which follow:

I claim:

1. A dual locking ring, comprising:

a. a first ring comprising a first ring band and at least one protrusion extending radially therefrom; and b. a second ring comprising at least one second ring band having a receptacle for said protrusion, wherein said protrusion and said receptacle lockingly attach said first and second rings together wherein the inner diameter of the first ring band is substantially the same as the inner diameter of the second ring band.

2. A ring according to claim 1 and wherein said at least one protrusion is at least one pair of protrusions defining a gap therebetween and wherein said receptacle is a channel, integrally formed with said second ring band, of length generally equal to the dimension of said gap, to receive said pair of protrusions therearound.

3. A ring according to claim 2 and wherein said first ring band has at least one set of at least one jewel set between said protrusions.

4. A ring according to claim 3 and wherein said channel is the width of said set of jewels.

5. A ring according to claim 2 and wherein said first ring band has two sets of protrusions and two sets of at least one jewel, wherein each set of jewels is set between each set of protrusions.

6. A ring according to claim 5 and wherein said channel is the width of said set of jewels.

7. A ring according to claim 1 and wherein said at least one protrusion is two pairs of protrusions, each of said pairs of protrusions defining a gap therebetween, wherein said first ring band has at least one set of at least one jewel set between said protrusions, and wherein said second ring comprises two second ring bands and wherein said receptacle is a bridge, integrally formed between said two second ring bands, of length generally equal to the dimension of said gap, to receive one of said pair of protrusions therearound.

8. A ring according to claim 7 wherein said first ring is generally round and wherein the outer circumference of said second ring band is non-round at least in a location corresponding to where one of said sets of jewels is located, in order to protect said set of jewels.

9. A ring according to claim 8 and wherein said sets of jewels are located on the top and bottom of said first ring and said non-round section is at the bottom of said second ring band in order to protect the set of jewels at the bottom of said first ring.

10. A ring according to claim 1 and wherein said protrusion is connected to a flange connected to said first ring and said receptacle is a hole within said second ring band, said hole having an inner diameter generally equal to the outer diameter of said protrusion.

11. A ring according to claim 10 and wherein said first ring comprises a single jewel and said second ring comprises at least one jewel set on the opposite side of said second ring band to said hole.

12. A ring according to claim 1 wherein the protrusion extends radially outwardly from said first ring band.

13. A dual locking ring, comprising:

a first ring comprising a first ring band and a pair of protrusions defining a gap therebetween; and a second ring comprising two second ring bands having a receptacle for said protrusion;

wherein said receptacle is a bridge, integrally formed between said two second ring bands, of a length generally equal to the dimension of said gap, to receive said pair of protrusions therearound; and wherein said pair of protrusions and said receptacle lockingly attach said first and second rings together.

14. A ring according to claim 13 wherein said second ring comprises a second bridge, approximately 180° from said first bridge.

15. A ring according to claim 14 and wherein said first ring band has at least one set of at least one jewel setoutside said protrusions.

16. A ring according to claim 15 wherein said first ring band is generally round and wherein the outer circumferences of said second ring bands are non-round at least in a location corresponding to where said at least one jewel set is located, in order to protect said jewel set.

17. A ring according to claim 16 wherein said first ring band has a second set of jewels and wherein said first and second sets of jewels are located on the top and bottom of said first ring.

18. A ring according to claim 14 wherein said first ring band has at least one set of at least one jewel set outside each said protrusion.

19. A ring according to claim 14 wherein said first ring band has at least two sets of jewels wherein each set contains at least one jewel and wherein at least one jewel of each said set is set outside each said protrusion.

20. A ring according to claim 14 wherein said first ring includes two sets of jewels located outside said gap, each set of jewels containing at least one jewel.

21. A ring according to claim 20 wherein said two sets of jewels are located approximately 180° apart on the first ring and wherein said pair of protrusions lock into either of the two bridges of the second ring.

22. A ring according to claim 13 wherein a jewel is mounted over said bridge of said second ring.

23. A ring according to claim 13 further comprising a set of jewels located between said protrusions and wherein said set of jewels contains at least one jewel.

24. A ring according to claim 23 wherein said set of jewels are on said first ring band, wherein said first ring band includes a second pair of protrusions and wherein said ring includes another set of jewels on said first ring band which are positioned between said second pair of protrusions.

25. A ring according to claim 13 wherein the pair of protrusions are parallel to the axis of the first ring band.

26. A ring according to claim 13 wherein the exterior edges of the first ring band are entirely perpendicular to the axis of the first ring band.

27. A ring according to claim 13 wherein the protrusions gradually rise out of the outer circumferential surface of the first ring band.

28. A ring according to claim 13 wherein said protrusions of the first ring do not extend onto any part of the outer circumferential surface of the second ring band.

* * * * *